United States Patent [19]

Barth et al.

[11] Patent Number: 4,603,617

[45] Date of Patent: Aug. 5, 1986

[54] MULTI-PART PLUNGER PISTON FOR INTERNAL COMBUSTION ENGINES

[75] Inventors: Alois Barth, Stuttgart; Lothar Wiemann, Weinstadt-Beutelsbach, both of Fed. Rep. of Germany

[73] Assignee: Mahle GmbH, Fed. Rep. of Germany

[21] Appl. No.: 746,068

[22] Filed: Jun. 18, 1985

[30] Foreign Application Priority Data

Jun. 27, 1984 [DE] Fed. Rep. of Germany ..... 3423559

[51] Int. Cl.[4] ..... F02F 3/02

[52] U.S. Cl. ..... 92/216; 92/220; 92/255; 29/526 R

[58] Field of Search ..... 92/216, 220, 255, 215, 92/221, 256; 403/274, 282, 121, 337, 285; 285/913; 123/193 P, 526 R; 29/156.5 R; 220/327, 328

[56] References Cited

U.S. PATENT DOCUMENTS 3,029,112 4/1962 Boyle ..... 92/220
3,960,048 6/1976 Wagner ..... 29/446
4,356,800 11/1982 Moebus ..... 123/193 P

*Primary Examiner*—Robert E. Garrett
*Assistant Examiner*—John M. Husar
*Attorney, Agent, or Firm*—James C. Wray

[57] ABSTRACT

A multi-part plunger piston for internal combustion engines, comprises a piston upper part and lower part which engage one on the other through coinciding annular abutment surfaces. The parts are connected with one another by screws which pass through the annular surfaces. At least one of the annular abutment surfaces is domed in the circumferential direction in such a way that the annular surfaces are more strongly resiliently braced in the region between the screws in the finally assembled piston than in the regions around the screws. Due to the elastic initial stressing of the regions of the annular abutment surfaces between the screws it is intended reliably to avoid lifting away of the annular abutment surfaces in these regions during engine operation. When the finally assembled piston is in the cold condition the annular surfaces lie uniformly against one another over the entire circumference, admittedly with locally differing initial stresses.

4 Claims, 2 Drawing Figures

MULTI-PART PLUNGER PISTON FOR INTERNAL COMBUSTION ENGINES

BACKGROUND OF THE INVENTION

The invention relates to a multi-part plunger piston for internal combustion engines, comprising a lower piston part for receiving the gudgeon pin and an upper part, these parts resting on one another by means of an annular abutment surface on each part, and screws for bracing the two parts together, the screws passing through the annular abutment surfaces.

STATEMENT OF PRIOR ART

A piston of this classification is known from Fed. German Publ. Spec. No. 2,821,176. In cases where the lower and upper piston parts are connected by only relatively few screws, as for example with four screws in the case of a piston diameter above 200 mm., it can occur in practice that the annular surfaces lift slightly away from one another under the thermal and mechanical stresses occurring in engine operation. This then leads to increased pressure effects in the regions around the screws which alone still rest on one another, with the consequence that the maximum loadings permissible according to the material are there exceeded. Moreover in the regions where the annular surfaces lift slightly away from one another the formation of cavitation can occur.

OBJECT OF THE INVENTION

An object of the invention is to develop a piston of this kind further so that in all operational conditions of the internal combustion engine secure abutment of the upper and lower piston parts, clamped against one another, is guaranteed.

SUMMARY OF THE INVENTION

According to the invention there is provided a piston for an internal combustion engine comprising a lower piston part having an end wall integral with a cylindrical skirt portion and means for receiving a gudgeon pin for connection of a connecting rod, said lower piston part being formed with a first annular locating surface and a first annular abutment surface lying substantially transversely of the piston axis provided radially inwardly of said first annular locating surface; an upper piston part serving as the piston head having a second annular locating surface cooperable with said first annular locating surface to ensure relative lateral location of said lower and upper piston parts and having a second abutment surface cooperable axially of the piston with said first annular abutment surface, and screws for bracing said lower and upper piston parts together, said screws passing through bores in said first and second abutment surfaces, the improvement comprising forming at least one of said first and second abutment surfaces with a slightly domed profile in the circumferential direction in the regions of said one abutment surface between the screws, whereby on assembly tightening of the screws effects deformation of the material in the region of the domed surfaces whereby the cooperating first and second abutment surfaces are in engagement over the regions between the screws.

BRIEF DESCRIPTION OF DRAWINGS

An example of embodiment is represented in the accompanying drawings, in which.

DESCRIPTION OF PREFERRED EMBODIMENTS

Figure 1:
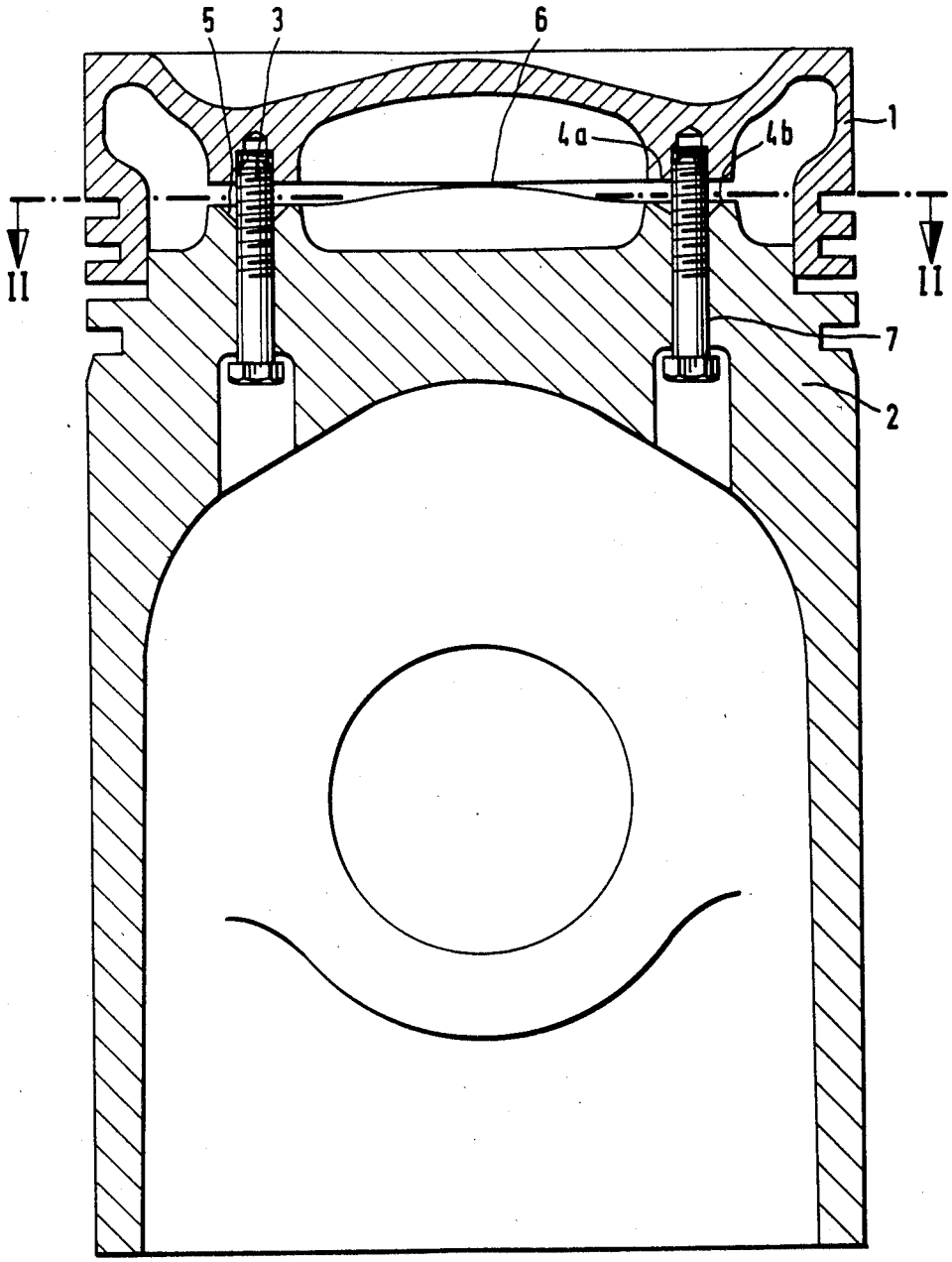
FIG. 1 is a section taken along the longitudinal axis at right angles to the axis of the gudgeon pin.
Figure 2:
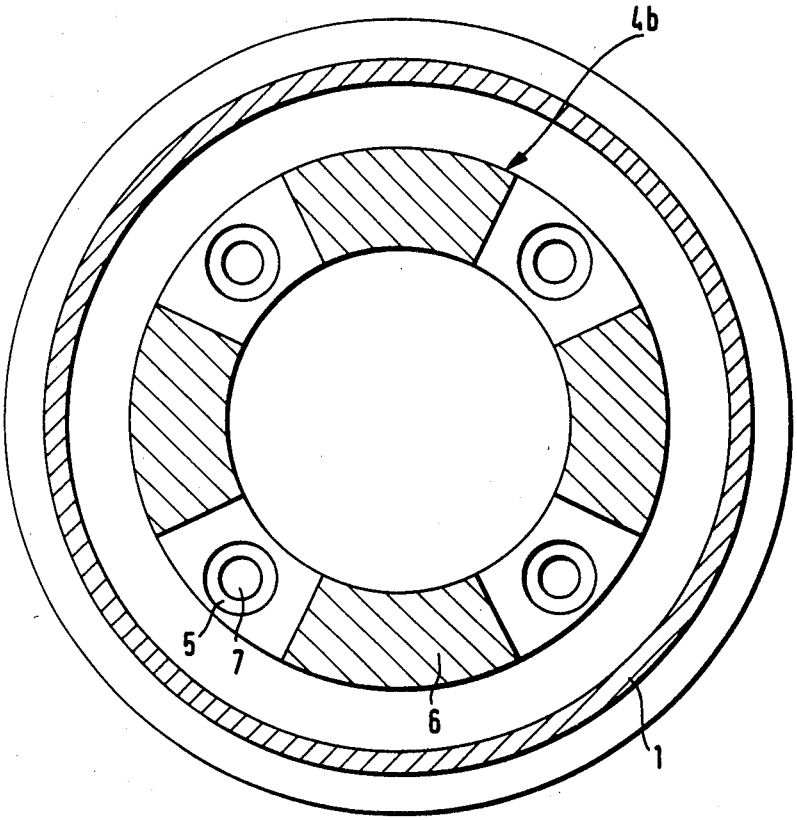
FIG. 2 is a section taken along the line II—II of FIG. 1.

The piston consists of an upper part 1 and a lower part 2, which are connected with one another by means of screws 3. The illustration of the piston shows it with the screws 3 fitted but not yet tightened fast. In the regions of the annular abutment surfaces 4,5 between the screws, of which there may be 2,3 or 4, these surfaces of the lower part 2 are slightly domed in the circumferential direction of the annular surface with the zenith of the doming 6 exactly in a region mid-way between two neighbouring screws 3. Each screwbore 7 is counter-sunk in the region 5 of the upper annular surface **4*b* of the lower part 2. Both abutment surfaces 4*a*, 4*b*** may be domed between the screw holes.

In the engaged but unbraced condition of the lower and upper piston parts the axial interval between the mutually opposite annular abutment surfaces increases continuously from the regions lying mid-way between adjacent screws towards the screws.

In the finally assembled piston the upper and lower parts 1,2 are tightened against one another by means of the screws in such a way that the annular surfaces **4*a*, 4*b* of the two parts 1, 2** lie on one another without gap over the entire circumference. Thus in the domed sections of the annular surfaces the material is under a corresponding initial stress which guarantees a secure abutment of the upper and lower piston parts under all operational conditions.

Due to the elastic initial stressing of the regions of the annular abutment surfaces **4*a*, 4*b* between the screws 3 it is intended reliably to avoid lifting away of the annular abutment surfaces in these regions during engine operation. When the finally assembled piston is in the cold condition the annular surfaces 4*a*, 4*b*** lie uniformly against one another over the entire circumference, admittedly with locally differing initial stresses.

The surfaces of the lower part 2 which are slightly domed are shown greatly exaggerated in FIG. 1. The apex of the dome may be from 0.01 to 0.1 mm above the plane containing the flat surfaces immediately surrounding the screw-bores 7.

We claim:

1. In a piston for an internal combustion engine comprising:

(a) a lower piston part having an end wall integral with a cylindrical skirt portion and means for receiving a gudgeon pin for connection of a connecting rod, said lower piston part being formed with a first annular locating surface and a first annular abutment surface lying substantially transversely of the piston axis provided radially inwardly of said first annular locating surface, (b) an upper piston part serving as the piston head having a second annular locating surface cooperable with said first annular locating surface to ensure relative lateral location of said lower and upper piston parts and having a second annular abutment surface cooperable axially of the piston with said first annular abutment surface, and (c) screws for bracing said lower and upper piston parts together, said screws passing through bores in said first and second abutment surfaces, the improvement comprising forming at least one of said first and second abutment surfaces with a slightly domed profile in the circumferential direction in the regions of said one abutment surface between the screws, whereby one assembly tightening of the screws effects deformation of the material in the region of the domed surfaces whereby the cooperating first and second abutment surfaces are in engagement over the regions between the screws.

2. A piston according to claim 1, wherein in the engaged but unbraced condition of the lower and upper piston parts the axial interval between the mutually opposite annular abutment surfaces increases continuously from the regions lying mid-way between adjacent screws towards the screws.

3. A piston according to claim 1, wherein the domed profile extending in the circumferential direction is the same over the radial extent of the annular abutment surfaces.

4. A piston according to claim 1, wherein the bores of the screws are counter-sunk as far as the radial edges of the annular abutment surfaces.

* * * * *